US005167536A

United States Patent [19]

Wang

[11] Patent Number: 5,167,536

[45] Date of Patent: Dec. 1, 1992

[54] CAPACTIVE COUPLED BNC TYPE CONNECTOR

[76] Inventor: Tsan-Chi Wang, No. 13, Lane 312, Chungcheng Rd., Hsin Tien City, Taipei Hsien, Taiwan

[21] Appl. No.: 837,927

[22] Filed: Feb. 20, 1992

[51] Int. Cl.[5] ..... H01R 13/66

[52] U.S. Cl. ..... 439/620; 333/185

[58] Field of Search ..... 333/181-185; 439/620

[56] References Cited

U.S. PATENT DOCUMENTS

| | | | |
|---|---|---|---|
| 4,797,120 | 1/1989 | Ulery | 439/620 |
| 4,884,982 | 12/1989 | Fleming et al. | 439/620 |
| 4,934,960 | 6/1990 | Capp et al. | 439/620 |
| 5,062,811 | 11/1991 | Hackman | 439/620 |
| 5,108,300 | 4/1992 | Weber | 439/620 |

*Primary Examiner*—Gary F. Paumen

*Attorney, Agent, or Firm*—Varndell Legal Group

[57] ABSTRACT

A capacitive coupled BNC type connector comprised of an insulative body, a shell inserted in said insulative body at one end for holding an electrical terminal and a ground terminal, and a conductive spring plate mounted on said insulator body, wherein said insulative body has a rectangular recess on an outer wall thereof at a location corresponding to a rectangular contact surface on said shell, said rectangular recess comprising an intermediate through hole for holding two capacitor elements, and two opposite bolt holes; said conductive spring plate has two opposed projecting strips transversely disposed at two opposite ends, and a rectangular board vertically disposed at one side between said two projecting strips, said rectangular board having two round holes respectively connected to said two bolt holes by screws permitting said capacitor elements to be firmly connected between said rectangular board of said conductive spring plate and said rectangular contact surface of said shell.

4 Claims, 5 Drawing Sheets

CAPACTIVE COUPLED BNC TYPE CONNECTOR

BACKGROUND OF THE INVENTION

The present invention relates to a BNC (bayonet navy connector) type connector. More particularly, the present invention relates to a capacitive coupled BNC type connector which provides good contact and can effectively eliminate outside noise.

According to conventional manufacturing method, a BNC type connector does not have any capacitors therein, and therefore, outside noises tend to interfere with the quality of transmission in a computer system. Several capacitive coupled BNC type connectors have been disclosed to eliminate this problem. U.S. Pat. No. 5,108,300 which issued on Apr. 28, 1992 discloses a capacitive coupled BNC type connector. However, this capacitive coupled BNC type connector is still not satisfactory in use. One disadvantage of this structure of capacitive coupled BNC type connector is that the conductive spring leaves can not firmly retain the capacitor elements in position. Another disadvantage of this structure of capacitive coupled BNC type connector is that the small contact area between the conductive spring leaves and the capacitor elements provide poor conductive effect. Further, the problem of contact failure between the spring leaves and the capacitor elements tends to happen, due to the elastic fatigue problem of the conductive spring leaves.

SUMMARY OF THE INVENTION

The present invention has been accomplished to eliminate the aforesaid disadvantages and problems. It is therefore the main object of the present invention to provide a capacitive coupled BNC type connector which has means to firmly retain capacitor elements in place for good contact so that outside noise signals can be completely eliminated upon its operation.

According to the present invention, there is provided a capacitive coupled BNC type connector which is generally comprised of an insulative body, a shell inserted in the insulative body at one end for holding an electrical terminal and a ground terminal, and a conductive spring plate mounted on the insulator body. The insulative body has a rectangular recess on an outer wall thereof at a location corresponding to a rectangular contact surface on the outer wall of the shell, which rectangular recess comprises an intermediate through hole for holding two capacitor elements, and two opposite bolt holes for fastening the conductive spring plate. The conductive spring plate has two opposed projecting strips transversely disposed at two opposite ends for positioning upon the installation of the BNC connector, and a rectangular board vertically disposed at one side between the two projecting strips, which rectangular board has two round holes respectively connected to the two bolt holes by screws. Therefore, the capacitor elements which are inserted in the intermediate through hole are firmly connected between the rectangular board of the conductive spring plate and the rectangular contact surface on the shell.

DETAILED DESCRIPTION OF THE PREFERRED EMBODIMENT

Figure 1:
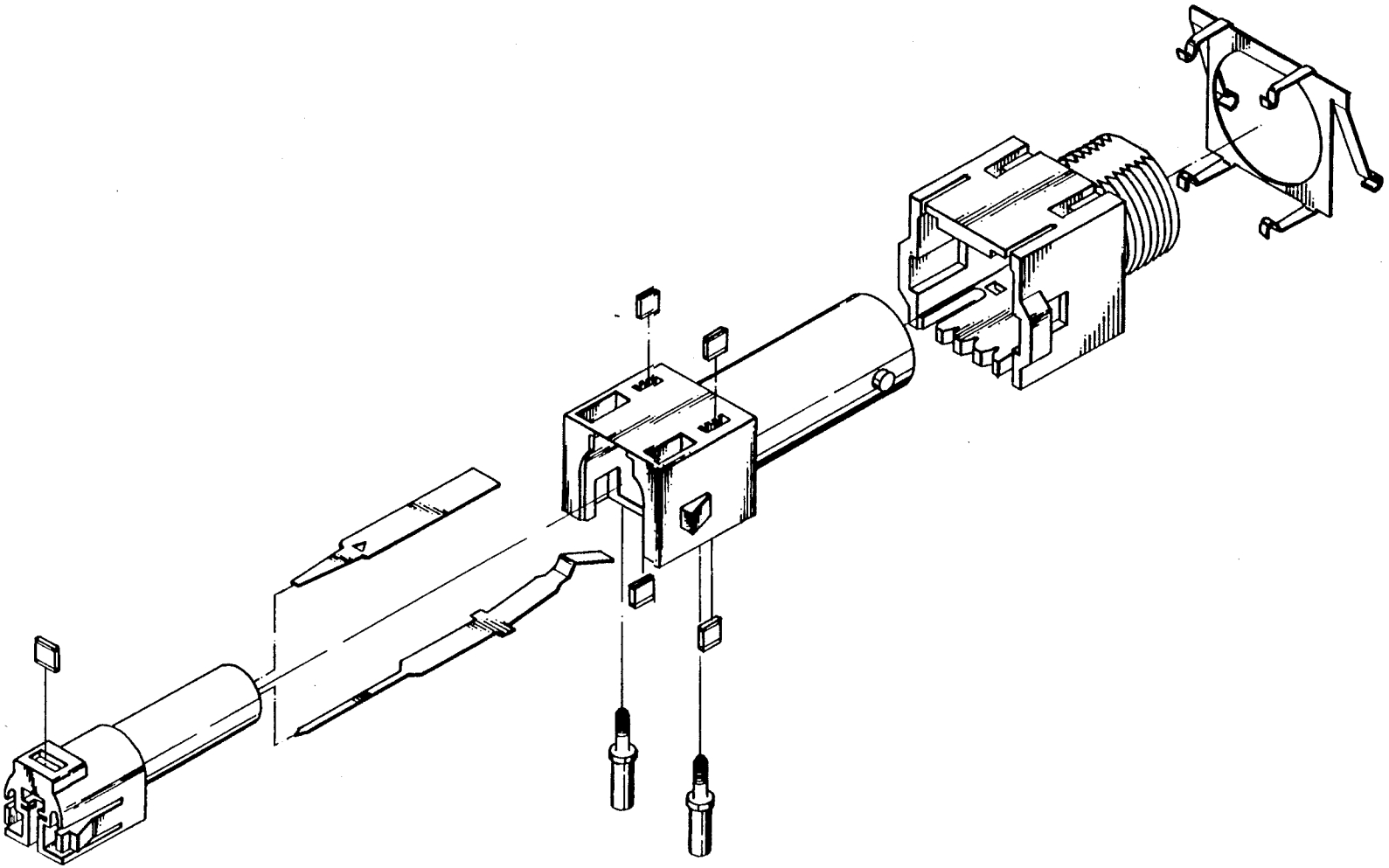
Fig. 1 PRIOR ART
FIG. 1 is an exploded view of a capacitive coupled BNC type connector according to the prior art.
Figure 2:
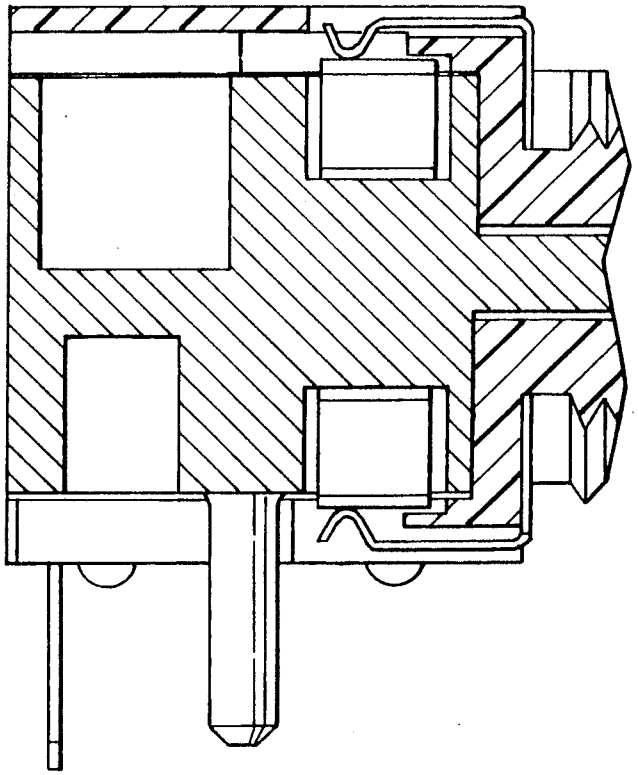
Fig. 2 PRIOR ART
FIG. 2 is a partly sectional view of the capacitive coupled BNC type connector of FIG. 1.
Figure 3:
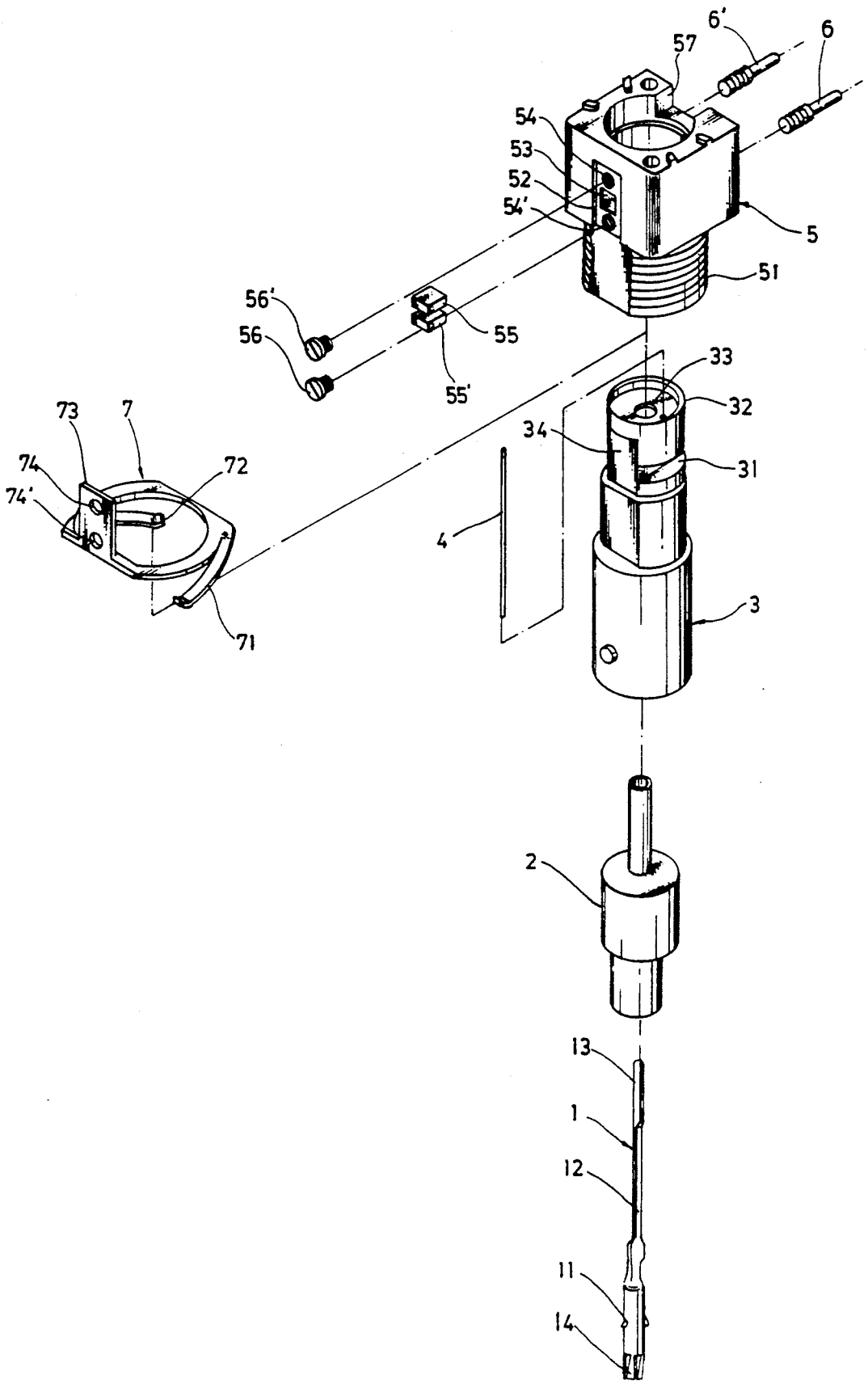
FIG. 3 is an exploded view of a capacitive coupled BNC type connector according to the present invention.
Figure 4:
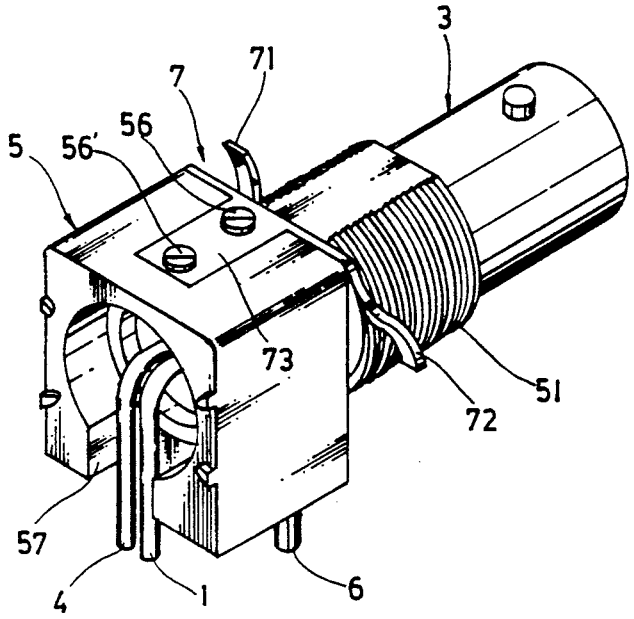
FIG. 4 is an elevational view of the capacitive coupled BNC type connector of FIG. 3.

Referring to FIGS. 3 and 4, an elongated electric terminal 1 is integrally made from a tin alloy through the process of punching, having a PC board connecting end 13 at one end, a bayonet base 14 at an opposite end, and a neck portion 12 at the middle. The neck portion 12 is formed in the shape of a flat strip convenient for gripping by a clamp or the like so that the bayonet base 14 can be treated with the process of gold plating so as to ensure better conductivity. Because the electric terminal 1 is made from a tin alloy, it can be conveniently directly connected to a PC board through the process of soldering. Further, the bayonet base 14 has unitary hooks 11 at two opposite locations. When the electric terminal 1 is inserted into a hollow rubber core 2, the hooks 11 hook in the inner surface of the hollow rubber core 2, and therefore, the electric terminal 1 becomes firmly retained in the hollow rubber core 2. The hollow rubber core 2 is made in the shape of a stepped cylinder inserted in a shell 3. The shell 3 has a circular center hole 33 through the central axis thereof for projecting the electric terminal 1, a small round hole 32 adjacent to the circular hole 33 for inserting a ground terminal 4, a notch 31 transversely disposed on the outer wall thereof, and a rectangular contact surface 34 longitudinally disposed on the outer wall thereof. The shell 3 is to be inserted in a connector 5. The connector 5 includes a hollow, square, insulative body having an externally threaded cylindrical portion 51 longitudinally aligned at one end. The insulative body of the connector 5 comprises a rectangular recess 52 at one side. The rectangular recess 52 has a square hole 53 at the middle for mounting two capacitor elements 55, 55', and two bolt holes 54, 54' at two opposite ends. There is provided a substantially ring-shaped, conductive spring plate 7 sleeved on the cylindrical portion 51 of the connector 5 and firmly secured to the square body thereof. The conductive spring plate 7 has two opposed projecting strips 71, 72 transversely disposed at two opposite ends, and a rectangular board 73 vertically disposed at one side between the two projecting strips 71, 72. The rectangular board 73 is made in such a size fitting the rectangular recess 52 on the square body of the connector 5, having two round holes 74, 74' at locations corresponding to the two opposite bolt holes 54, 54' on the rectangular recess 52. As soon as the connector 5 has been mounted on the shell 3, the capacitor elements 55 are stopped against the rectangular contact surface 34. After the ring-shaped conductive spring plate 7 having been sleeved on the cylindrical portion 51 of the connector 5, the rectangular board 73 is engaged in the rectangular recess 52 with the round holes 74, 74' respectively secured to the bolt holes 54, 54' by screws 56, 56', and therefore, the capacitor elements 55, 55' become firmly retained between the rectangular board 73 and the rectangular contact surface 34. Further, there are two fastening bolts 6, 6' attached to the connector 5 at one side opposite to the rectangular recess 52 for connecting to a PC board. The connector 5 further has a notch 57 on a peripheral top edge thereof for leading out the electric terminal 1 and the ground terminal 4 (see FIG. 4).

Figure 5:
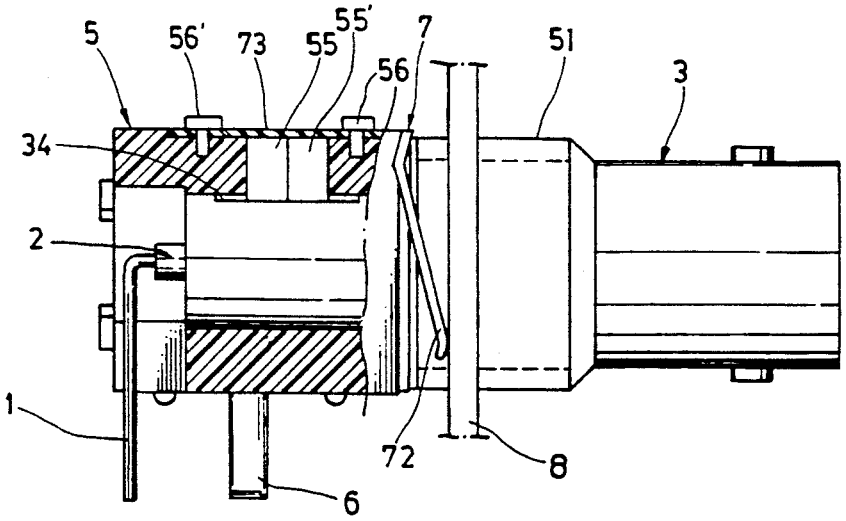
FIG. 5 is a sectional side view of the capacitive coupled BNC type connector of FIG. 3.
Figure 6:
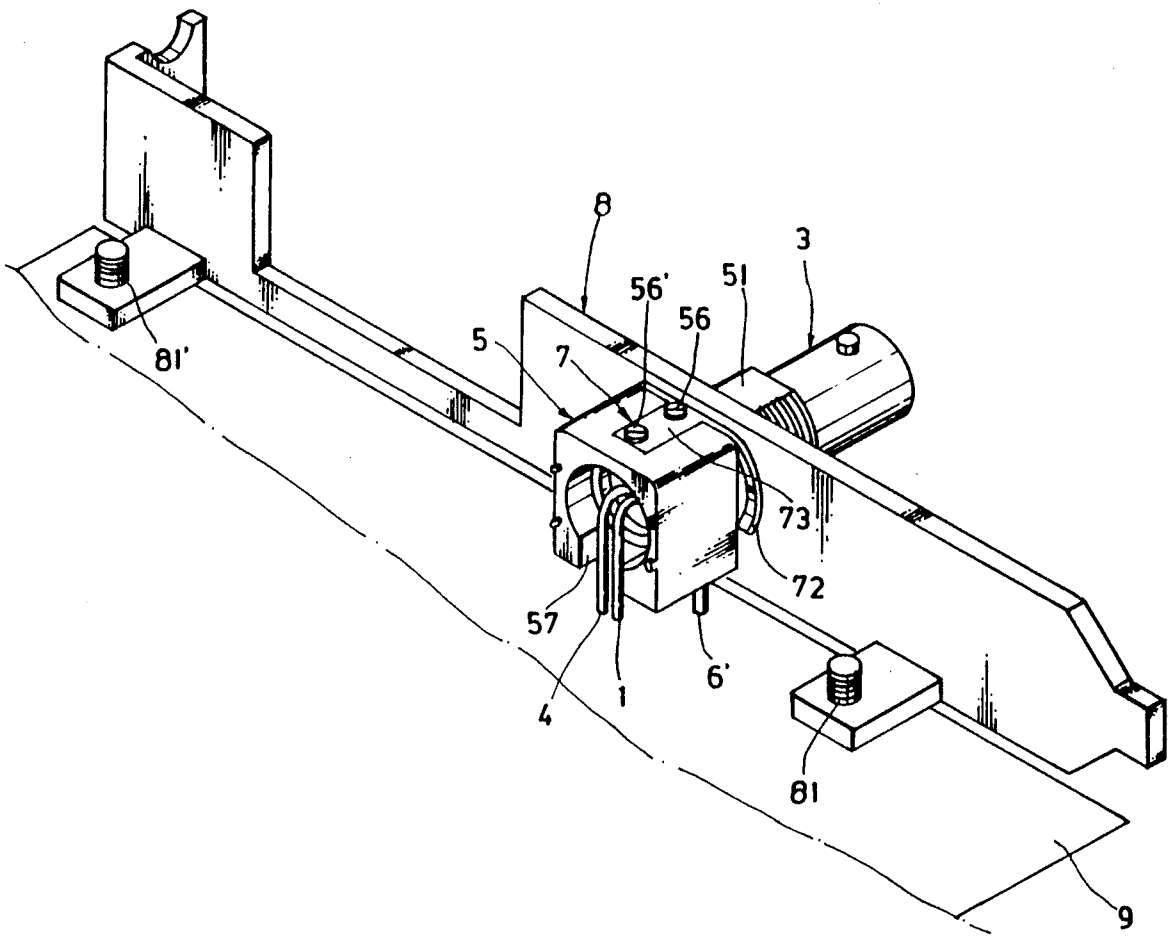
FIG. 6 illustrates an installation example of the present invention.

Referring to FIGS. 5 and 6, the capacitive coupled BNC type connector is inserted into a hole (not shown) on a conductive panel 8 with the fastening bolts 6, 6' and the terminals 1, 4 soldered to a PC board 9, wherein the conductive panel 8 is secured to the PC board 9 by screws 81, 81'. Therefore, the two projecting strips 71, 72 of the conductive spring plate 7 are stopped between the connector 5 and the conductive panel 8 to firmly stably support the connector 5 on the conductive panel 8. As shown in FIG. 5, external noise signals induced by the conductive panel 8 are transmitted through the conductive spring plate 7 to the capacitor elements 55, 55'. Because the capacitor elements 55, 55' are connected between the shell 3 and the conductive spring plate 7, any external noise signals induced by the conductive panel 8 will be filtered by the capacitor elements 55, 55'.

I claim:

1. A capacitive coupled BNC type connector, comprised of an insulative body, a shell inserted in said insulative body at one end for holding an electrical terminal and a ground terminal, and a conductive spring plate mounted on said insulator body, and characterized in that said insulative body has a rectangular recess on an outer wall thereof at a location corresponding to a rectangular contact surface on said shell, said rectangular recess comprising an intermediate through hole and two opposite bolt holes; said conductive spring plate has two opposed projecting strips transversely disposed at two opposite ends, and a rectangular board vertically disposed at one side between said two projecting strips, said rectangular board having two round holes at locations corresponding to said two bolt holes.

2. The capacitive coupled BNC type connector of claim 1, which further comprises two capacitor elements connected in parallel and inserted in said intermediate through hole on said insulative body.

3. The capacitive coupled BNC type connector of claim 1, wherein said rectangular board of said conductive spring plate fits said rectangular recess on said insulative body.

4. The capacitive coupled BNC connector of claim 1, wherein said two round holes on said rectangular board of said conductive spring plate are respectively connected to said two bolt holes on said rectangular recess by screws permitting said capacitor elements to be firmly connected between said rectangular board of said conductive spring plate and said rectangular contact surface of said shell.

* * * * *

UNITED STATES PATENT AND TRADEMARK OFFICE

CERTIFICATE OF CORRECTION

PATENT NO. : 5,167,536
DATED : December 1, 1992
INVENTOR(S) : Tsan-Chi Wang

It is certified that error appears in the above-indentified patent and that said Letters Patent is hereby corrected as shown below:

On the Title page, item [54], change "CAPACTIVE COUPLED BNC TYPE CONNECTOR" to --CAPACITIVE COUPLED BNC TYPE CONNECTOP--.

Signed and Sealed this

Nineteenth Day of October, 1993

*Attest:*

*Attesting Officer*

BRUCE LEHMAN

*Commissioner of Patents and Trademarks*